US012735862B2

(12) United States Patent
Finkenzeller et al.

(10) Patent No.: US 12,735,862 B2
(45) Date of Patent: Sep. 15, 2026

(54) TRENCH WALL CUTTING DEVICE AND METHOD FOR CUTTING A CUTTING TRENCH IN THE GROUND

(71) Applicant: BAUER Maschinen GmbH, Schrobenhausen (DE)

(72) Inventors: Stefan Michael Finkenzeller, Reichertshofen (DE); Leonhard Weixler, Thierhaupten (DE); Stefan Roth, Schrobenhausen (DE); Alexander Blatt, Schrobenhausen (DE); Christian Herrmann, Aichach (DE); Ulli Wiedenmann, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 448 days.

(21) Appl. No.: 18/548,494

(22) PCT Filed: Feb. 16, 2022

(86) PCT No.: PCT/EP2022/053737
§ 371 (c)(1),
(2) Date: Aug. 30, 2023

(87) PCT Pub. No.: WO2022/184429
PCT Pub. Date: Sep. 9, 2022

(65) Prior Publication Data

US 2024/0141614 A1 May 2, 2024

(30) Foreign Application Priority Data

Mar. 1, 2021 (EP) ..... 21160039

(51) Int. Cl.
*E02F 5/02* (2006.01)
*E02F 3/20* (2006.01)
(Continued)

(52) U.S. Cl.
CPC ..... *E02F 5/02* (2013.01); *E02F 3/205* (2013.01); *E02F 3/241* (2013.01); *E02F 3/3677* (2013.01)

(58) Field of Classification Search
CPC . E02F 3/188; E02F 3/205; E02F 3/241; E02F 3/3677; E02F 5/00; E02F 5/02; E02F 5/022; E02F 5/10; E21D 9/001
(Continued)

(56) References Cited

U.S. PATENT DOCUMENTS

2017/0292635 A1* 10/2017 Raffuzzi ..... F16G 15/12
2020/0232183 A1* 7/2020 Rhomberg ..... E02F 3/188

FOREIGN PATENT DOCUMENTS

EP 0735199 A1 * 10/1996 ..... E02D 17/13
EP 05 18 297 B1 2/1997
(Continued)

OTHER PUBLICATIONS

EP-3719207-A1 (Year: 2020).*
(Continued)

*Primary Examiner* — Christopher J Sebesta
*Assistant Examiner* — Evan A Bregel
(74) *Attorney, Agent, or Firm* — Studebaker Brackett PLLC

(57) ABSTRACT

The invention relates to a trench wall cutting device comprising a trench cutter having at least one cutting frame unit and at least two cutting wheels arranged in the longitudinal direction of the cutting frame unit and is configured for cutting a substantially vertical cutting trench in the ground, a supporting structure for suspending the trench cutter in a cutting position and moving it in a substantially vertical cutting direction for creating the cutting trench, and a feed device for feeding the trench cutter in a feeding direction which is oriented transversely to the cutting direction.
(Continued)

Figure 1:
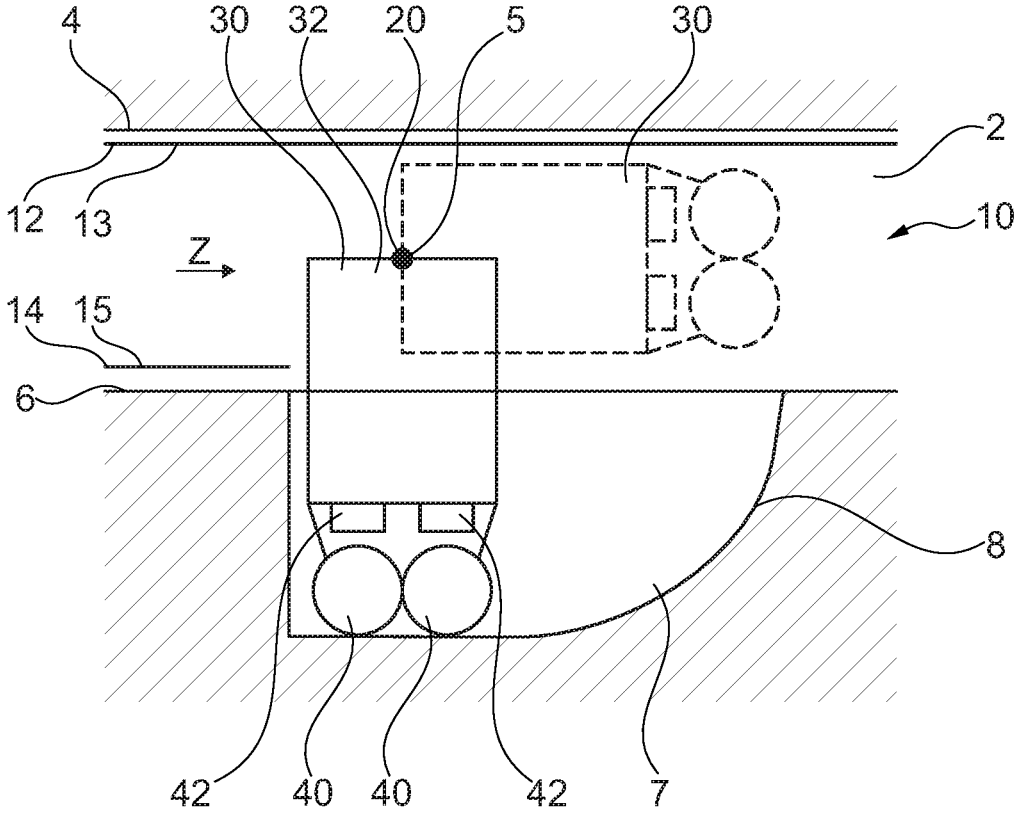

According to the invention, it is provided that the feed device is configured for feeding the at least one cutting frame unit with the two cutting wheels in a transversely-oriented feed position, wherein the longitudinal direction of the cutting frame unit is oriented in parallel to the feeding direction, and that a pivoting device is provided by means of which the cutting frame unit with the cutting wheels can be pivoted from the transversely-oriented feed position into the substantially vertical cutting position.

11 Claims, 2 Drawing Sheets

(51) Int. Cl.
*E02F 3/24* (2006.01)
*E02F 3/36* (2006.01)

(58) Field of Classification Search
USPC ..... 37/347, 92, 94
See application file for complete search history.

(56) References Cited

FOREIGN PATENT DOCUMENTS

| | | | | | |
|---|---|---|---|---|---|
| EP | 3 208 384 | B1 | | 5/2018 | |
| EP | 3 683 361 | A1 | | 7/2020 | |
| EP | 3719207 | A1 | * | 10/2020 | ..... E02D 17/13 |
| JP | 08209741 | A | * | 8/1996 | |
| JP | H08-209741 | A | | 8/1996 | |
| KR | 10-2018-0053329 | A | | 5/2018 | |
| WO | 2017/042495 | A1 | | 3/2017 | |

OTHER PUBLICATIONS

JP-08209741-A (Year: 1996).*
An Office Action mailed by the Korean Intellectual Property Office on Apr. 1, 2025, which corresponds to Korean Patent Application No. 10-2023-7027259 and is related to U.S. Appl. No. 18/548,494.
International Preliminary Report on Patentability and Written Opinion issued in PCT/EP2022/053737 on Aug. 29, 2023.
International Search Report issued in PCT/EP2022/053737; mailed May 9, 2022.

* cited by examiner

TRENCH WALL CUTTING DEVICE AND METHOD FOR CUTTING A CUTTING TRENCH IN THE GROUND

The invention relates to a trench wall cutting device comprising a trench cutter having at least one cutting frame unit and at least two cutting wheels arranged in the longitudinal direction of the cutting frame unit and is configured for cutting a substantially vertical cutting trench in the ground, a supporting structure for suspending the trench cutter in a cutting position and moving it in a substantially vertical cutting direction for creating the cutting trench, and a feed device for feeding the trench cutter in a feeding direction which is oriented transversely to the cutting direction, according to the preamble of claim 1.

Furthermore, the invention relates to a method for cutting a cutting trench in the ground with a trench wall cutting device, wherein a supporting structure and a feed device are arranged, a trench cutter with at least one cutting frame unit and cutting wheels is fed to a working area in a feeding direction with the feed device, which is oriented transversely to a cutting direction, and the trench cutter is suspended from the supporting structure and moved in a substantially vertical cutting direction, wherein a cutting trench is created in the ground by cutting off ground material, according to the preamble of claim 9.

Trench wall cutting devices are used to create individual trenches, trench walls or diaphragm walls that can reach depths of up to 100 meters and more. Such trench walls or diaphragm walls are used, for example, to support excavation pits or to create a water barrier. It is also possible to mine mineral resources with such cutters.

In certain cases, it is necessary to construct a wall using the trench wall method in or close to a structure, in a tunnel or under confined space conditions. For this purpose, conventional carrier devices with large masts and large trench cutters cannot be used.

EP 05 18 297 B1 describes a compact trench wall cutting device to create trenches. This trench wall cutting device has a rail-guided carriage with a frame and a boom arm, which is only slightly higher than a vertical length of the trench cutter. A cable drum for a support cable as well as connecting cables and a hose drum for a supply hose are mounted close to the ground on the support frame. The trench cutter is limited to the essential components, such as cutting wheels, drives and pumps, and a guide frame is formed small.

EP 3 208 384 B1 discloses another compact trench wall cutting device. In this device, a compact trench cutter is adjustably mounted below a yoke, which is formed by two carrier units arranged next to one another. The two carrier units are connected to one another via a pivot joint having a vertical pivot axis.

In these known trench wall cutting devices, an insert height is substantially limited by the height of the trench cutter. In this context, a trench cutter cannot arbitrarily be reduced in size, since a certain size is required for the cutting wheels, the drives, the pump and, in particular, for a guide frame.

A generic cutting device is disclosed in EP 3 719 207 A1. In this known trench wall cutting device, a trench cutter is divided into at least two cutter modules, which are fed along a scaffold-like supporting structure with a guide device to a working area, where the individual cutter modules are assembled to form the cutter. The individual cutter modules are suspended along rails along a ceiling area for being displaceable.

The object underlying the invention is to provide a trench wall cutting device and a method for cutting a cutting trench in the ground, by means of which efficient cutting is made possible even under particularly confined space conditions.

The object is achieved on the one hand by a trench wall cutting device according to claim 1 and on the other hand with a method according to claim 9. Preferred embodiments of the invention are indicated in the respective dependent claims.

According to the invention, a trench wall cutting device is characterized in that the feed device is configured for feeding the at least one cutting frame unit with the two cutting wheels in a transverse feed position, wherein the longitudinal direction of the cutting frame unit is oriented in parallel to the feeding direction, and in that a pivoting device is provided by means of which the cutting frame unit with the cutting wheels can be pivoted from the transversely-oriented feed position into the substantially vertical cutting position.

A basic idea of the invention can be considered the feeding of at least one cutting frame unit with the at least two cutting wheels in a transversely-oriented feed position, i.e. in a lying position, to a working area. This allows a trench cutter to be fed even in very confined conditions, for example in a tunnel or in buildings with low ceiling heights. A rail track, roller carriers or other chassis can be used as the feed device. Preferably, the one or more cutting frame units rest thereon, so that a load can be easily absorbed by the ground.

At a working area, the at least one cutting frame unit can then be pivoted together with the cutting wheels from the transversely-oriented or lying feed position into a vertical position by means of a pivoting device. The pivoting amounts to about 90°. In this case, a longitudinal direction of the trench cutter is pivoted from a horizontal orientation to a vertical orientation corresponding to the cutting direction. Any suitable device can be used for the pivoting device, such as a lever and/or cable system. For the pivoting, a receiving recess can be provided in the ground into which the at least one cutting frame unit is pivoted.

In the feed position, the trench cutter is then suspended on a supporting structure by means of which the trench cutter can be moved in the vertical cutting direction and a cutting trench can be excavated by the rotatingly driven cutting wheels. A supply of cutting slurry and/or a pumping off of milled material with cutting slurry can be carried out in a basically known manner via corresponding pump units.

According to a further development of the invention, it is particularly preferred that the feed device has at least one rail along which the at least one cutting frame unit can be displaced. The at least one rail can thereby be arranged on the ground or also on a ceiling area. Preferably, multiple rails are provided, wherein the at least one cutting frame unit itself is provided with skids or rollers or is mounted displaceable along the at least two parallel rails via a corresponding carrier or via a vehicle chassis.

For a simple design, according to one embodiment variant of the invention, it is preferred that the trench cutter is formed by a single cutting frame unit on which the cutting wheels are mounted. The cutting frame unit with the cutting wheels mounted thereon thus constitutes the trench cutter, which can be pivoted into a cutting position at the desired working location. Preferably, a receiving recess is provided in the ground in which the at least one cutting frame unit with the cutting wheels can be pivoted downward into a vertical cutting position. The receiving recess can have a depth as far as to the height of the trench cutter and preferably comprise an arcuate side area for pivoting in.

In principle, the pivoting device for the arrangement according to the invention can be of arbitrary design. According to a further development of the invention, it is advantageous that the pivoting device is arranged on the feed device and/or the supporting structure. In this case, the pivoting device can have an active pivoting drive, which comprises for example, a cable winch and/or a cylinder, which can bring about a desired pivoting movement on the at least one cutting frame unit via a corresponding lever mechanism. The pivoting device may also comprise one or more pivot joints or pivotable tilting means, by means of which a controlled pivoting movement of the cutting frame unit can be performed. An edge of a receiving recess on the ground may be reinforced by a frame, in particular a pivoting frame.

A further preferred embodiment of the invention is that a plurality of cutting frame units are provided for forming the trench cutter, wherein the cutting wheels are mounted on one cutting frame unit and additionally at least one further cutting frame unit is detachably attached thereto. The individual cutting frame units form modules, so to speak, which can be arranged and attached one above the other to form in this way the trench cutter as a whole. The division of the trench cutter into a plurality of modular cutting frame units simplifies feeding in confined spaces.

According to a variant of the invention, it is particularly advantageous that the cutting frame units are connected to the respective adjacent cutting frame unit via at least one pivot joint. In this way, the cutting frame units can be delivered already connected to one another or can be connected to one another directly at the work location via the pivot joints. The individual cutting frame units can then be pivoted in one after the other, preferably into a receiving recess, wherein due to the connection of the individual cutting frame units via a lateral pivot joint, these can be guided to follow almost automatically.

In principle, the cutting frame units can have substantially the same design. According to a further development of the invention, it is preferred that a first cutting frame unit with the cutting wheels and at least one further cutting frame unit with a drive unit, a pump unit, a supply unit, guide plates and/or a holding device are provided. The individual cutting frame units thus each have a specific function in the assembled trench cutter. The trench cutter can be assembled from two, three or more cutting frame units, which are arranged one behind the other in a longitudinal direction of the trench cutter.

According to one embodiment of the invention, it is particularly advantageous that the trench cutter has two pairs of cutting wheels, wherein each pair of cutting wheels is driven in rotation about a common cutter wheel axis. The two cutting wheel axes are arranged parallel to and offset from each other. The cutting wheels can be driven in the same direction or in opposite directions. Preferably, a suction-off device and/or a suspension introduction device is provided between the cutting wheels.

The method according to the invention is characterized in that the at least one cutting frame unit with the cutting wheels is fed in a transversely-oriented feed position by means of the feed device, wherein a longitudinal direction of the cutting frame unit is oriented in parallel to the feed device, and in that the at least one cutting frame unit with the cutting wheels is pivoted by means of a pivoting device from the transversely oriented feed position into a substantially vertical cutting position.

The method according to the invention can be performed in particular with the above-described trench wall cutting device. The advantages described above can be achieved.

A preferred variant of the method according to the invention is that a receiving recess is excavated in advance at the working area for creating the cutting trench, in which recess the at least one cutting frame unit and the cutting wheels are pivoted into the cutting position. The dimensions of the receiving recess can be configured in particular in such a way that when it is pivoted in, there is no or no significant increase in the height of the cutting frame units compared with the transversely-oriented lying position. A chamfer or an arcuate area can be provided on the side areas of the receiving recess to facilitate pivoting into the ground. Preferably, a frame can be formed along the receiving recess to stiffen the edge. The frame can simultaneously serve as a guide frame during cutting. At least one part of the pivoting device for pivoting the at least one cutting frame unit can be formed on the frame.

In principle, the trench cutter can be formed from a single cutting frame unit. According to a further development of the invention, it is particularly preferred that the trench cutter is assembled from a plurality cutting frame units at the working area. In this way, even in the case of very limited ceiling heights, trench cutters with relatively long guide frames can be formed which allow for particularly good guidance and thus enable a cutting trench to be created with particular accuracy of position.

In principle, only a single cutting trench can be created using the method. According to a further development of the invention, it is particularly advantageous that at least two adjacent cutting trenches are created, wherein after the creation of a first cutting trench, the trench cutter is retracted from the first cutting trench, if necessary with disconnecting of the plurality of cutting frame units, and that for creating a further cutting trench, the cutting frame units are moved along the feed device and reconnected to the trench cutter, which is then lowered into the ground while cutting off ground material. In this process, a second and further cutting trenches can be created in the ground, which are preferably adjacent to each other directly or spaced apart by about one trench length.

A particularly preferred embodiment of the invention is that, to form a trench wall in the ground, the at least one cutting trench is filled with a settable suspension which cures to become the wall mass. In this way, a foundation element or a retaining and/or diaphragm wall can be created in the ground for an excavation enclosure by means of a plurality of adjacent, adjoining cutting trenches.

Figure 2:
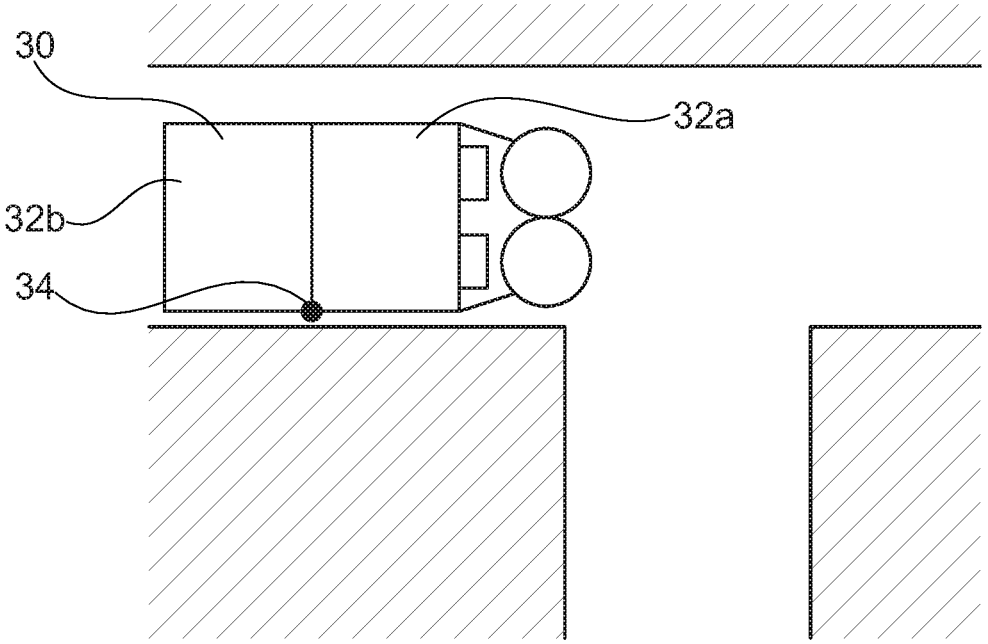
Figure 3:
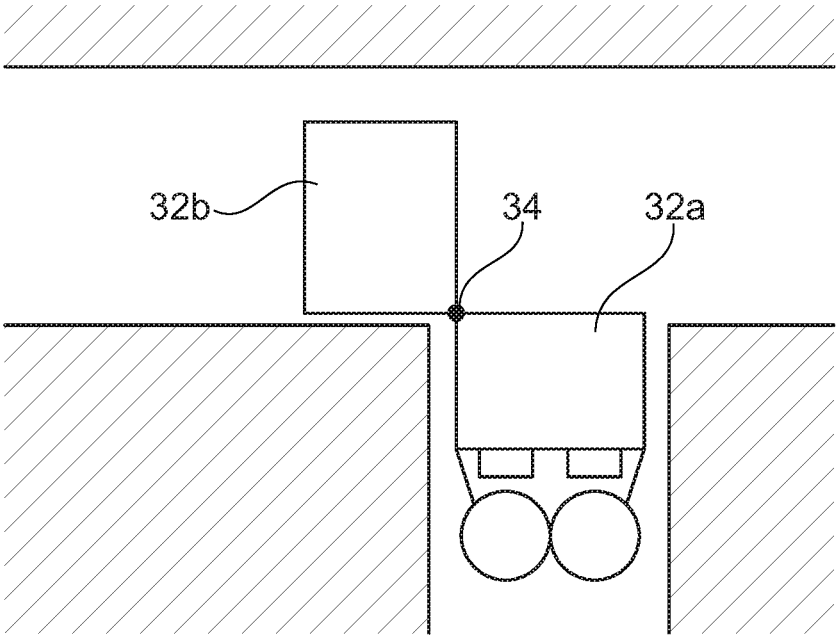
Figure 4:
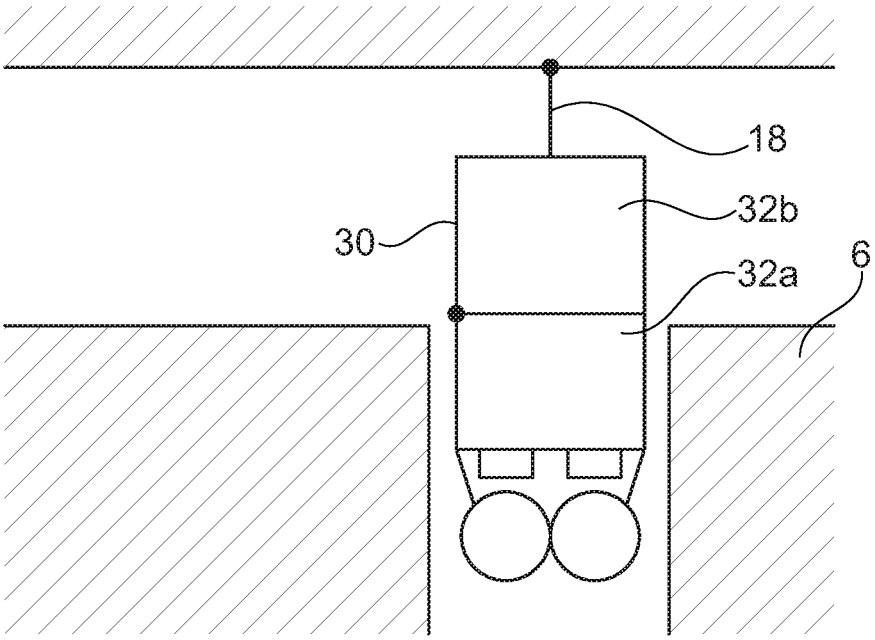

The invention is further described below with reference to preferred exemplary embodiments, which are shown schematically in the drawings. The drawings show in:

FIG. 1 a schematic side view of a first trench wall cutting device according to the invention;

FIG. 2 a first schematic side view of a further trench wall cutting device according to the invention during feeding to a working area;

FIG. 3 a schematic view of the trench wall cutting device of FIG. 2 pivoting into a receiving recess; and FIG. 4 a schematic representation of the trench wall cutting device of FIGS. 2 and 3 in the cutting position.

A first trench wall cutting device 10 according to the invention as shown in FIG. 1 is arranged in a tunnel 2 with a ceiling area 4 and a ground 6, in which a receiving recess 7 with an arcuate side area 8 is introduced. Along the tunnel 2, a supporting structure 12 with a ceiling beam 13, which is only indicated schematically, is arranged. A feed device 14 with a rail 15 is arranged along the ground 6. The feed device 14 may be connected to the supporting structure 12 via vertical struts (not illustrated) and may constitute a part thereof.

Along the feed device 14, a trench cutter 30 is fed along a horizontal feeding direction Z in a transversely-oriented or lying position, as shown with dashed illustration. In the illustrated exemplary embodiment, the trench cutter 30 is formed with a single cutting frame unit 32 having two pairs of cutting wheels 40 disposed on the underside thereof. A suction device 42 may be arranged above the cutting wheels 40 for suctioning off cut-away ground material.

When a working area is reached, the cutting frame unit 32 of the trench cutter 30 can be pivoted by about 90° into a cutting position into the receiving recess 7 by means of a pivoting device 20 with a pivot axis S oriented horizontally and transversely to the feeding direction Z, as is illustrated clearly in FIG. 1.

In the cutting position, the cutting wheels 40 of the trench cutter 30 are oriented downward, with an overall longitudinal direction of the cutting frame unit 32 being aligned vertically. The trench cutter 30 is suspended from the supporting structure 12 and can be lowered vertically into the ground 6 and retracted therefrom via a holding device, not shown, with at least one support cable. An energy supply as well as a supply and/or a discharge of suspension can be effected via lines (not illustrated), which are mounted on line drums along the supporting structure 12.

According to FIGS. 2 to 4, an alternative trench wall cutting device 10 is shown, which is constructed from two cutting frame units 32. Here, the cutting wheels 40 are mounted on a first cutting frame unit 32*a*. Adjacent to the first cutting frame unit 32*a*, a second cutting frame unit 32*b* is provided, which is pivotably connected to the first cutting frame unit 32*a* via a pivot joint 34.

According to FIG. 2, a feed of the trench cutter 30 with the two cutting frame units 32*a*, 32*b* takes place along a supporting structure (not illustrated) and a feed device (not illustrated) which can be configured according to the embodiment of FIG. 1.

When reaching a working area in the manner shown in FIG. 3, the first cutting frame unit 32*a* can be pivoted about the pivot joint 34 by about 90° downward into a receiving recess 7 by means of a pivoting device (not shown in greater detail).

Subsequently, the second cutting frame unit 32*b* can be after-pivoted about the pivot joint 34 of the first cutting frame unit 32*a*, as clearly shown in FIG. 4.

The two cutting frame units 32*a*, 32*b* can be firmly connected to each other in the assembled vertical position via a detachable connecting device (not shown in greater detail), so that cutting away can then be carried out by lowering the trench cutter 30 into the ground 6. In this process, the trench cutter 30 can be moved vertically via a support cable as a holding device 18 on the supporting structure.

After reaching a final depth, the trench cutter 30 can be retracted from the cutting trench again, whereupon the individual cutting frame units 32 are released from each other again and pivoted back about the pivot joint 34 into the horizontal or transversely-oriented feed position according to FIG. 2.

In the two exemplary embodiments shown, the trench cutter 10 or the individual cutting frame units 32*a* and 32*b* are each pivoted about an axis parallel to the axis of rotation of the cutting wheels. Of course, it is likewise possible and within the scope of the invention that pivoting is performed about a pivot axis that is perpendicular to the axis of rotation of the cutting wheels 40 and is preferably horizontal, i.e. in the lying position the two pairs of cutting wheels 40 are not arranged one above the other but side by side.

The invention claimed is:

1. A trench wall cutting device, comprising a trench cutter comprising at least one cutting frame unit and at least two cutting wheels arranged in the longitudinal direction of the cutting frame unit, the trench cutter being configured for cutting a vertical cutting trench in the ground, a supporting structure for suspending the trench cutter in a cutting position and configured to move the trench cutter vertical cutting direction to create the cutting trench, and a feed device for feeding the trench cutter in a feeding direction which is oriented transversely to the cutting direction, wherein the feed device is configured for feeding the at least one cutting frame unit with the two cutting wheels in a transversely oriented feed position, wherein the longitudinal direction of the cutting frame unit is oriented in parallel to the feeding direction, the trench wall cutting device further comprises a pivoting device configured to pivot the cutting frame unit with the cutting wheels 90 degrees from the transversely-oriented feed position into the vertical cutting position, a plurality of cutting frame units are provided for forming the trench cutter, wherein the cutting wheels are mounted on a cutting frame unit and, in addition, at least one further cutting frame unit is detachably attached thereto, and the cutting frame units are connected to the respective adjacent cutting frame unit via at least one pivot joint.

2. The trench wall cutting device according to claim 1, wherein the feed device comprises at least one rail along which the at least one cutting frame unit can be displaced.

3. The trench wall cutting device according to claim 1, wherein the pivoting device is arranged on the feed device and/or the supporting structure.

4. The trench wall cutting device according to claim 1, wherein a first cutting frame unit with the cutting wheels and at least one further cutting frame unit with a drive unit, a pump unit, a supply unit, guide plates and/or a holding device are provided.

5. The trench wall cutting device according to claim 1, wherein the trench cutter comprises two pairs of cutting wheels.

6. A method for cutting a cutting trench in the ground with a trench wall cutting device according to claim 1, in which a supporting structure and a feed device are arranged, a trench cutter with at least one cutting frame unit and cutting wheels is fed to a working area by means of the feed device in a feeding direction which is oriented transversely to a cutting direction, and the trench cutter is suspended from the supporting structure and moved in a vertical cutting direction, wherein a cutting trench is created in the ground by cutting away ground material, wherein the at least one cutting frame unit with the cutting wheels is fed in a transversely-oriented feed position by means of the feed device, wherein a longitudinal direction of the cutting frame unit is oriented in parallel to the feed device, and the at least one cutting frame unit with the cutting wheels is pivoted from the transversely oriented feed position into a vertical cutting position by means of a pivoting device.

7. The method according to claim 6, wherein a receiving recess is excavated in advance at the working area for forming the cutting trench, in which recess the at least one cutting frame unit and the cutting wheels are pivoted into the cutting position.

8. The method according to claim 6, wherein the trench cutter is assembled from a plurality of cutting frame units at the working area.

9. The method according to claim 6, wherein at least two adjacent cutting trenches are created, wherein after the creation of a first cutting trench the trench cutter is retracted from the first cutting trench, if necessary, with disconnecting of the plurality of cutting frame units, and in order to create a further cutting trench, the cutting frame units are moved along the feed device and reconnected to form the trench cutter, which is then lowered into the ground while cutting off ground material.

10. The method according to claim 6, wherein in order to create a trench wall in the ground, the at least one cutting trench is filled with a settable suspension which cures to become the trench wall.

11. The trench wall cutting device according to claim 1, wherein the transversely-oriented feed position is a horizontal position.

* * * * *